US005375533A

United States Patent [19]

Schwendt

[11] Patent Number: 5,375,533

[45] Date of Patent: Dec. 27, 1994

[54] RUNNING GEAR FOR RAIL VEHICLES WITH RADIAL CONTROL OF THE WHEELSETS

[75] Inventor: Lutz Schwendt, Vellmar, Germany

[73] Assignee: ABBHenschel Lokomotiven GmbH, Mannheim, Germany

[21] Appl. No.: 213,372

[22] Filed: Mar. 14, 1994

Related U.S. Application Data

[63] Continuation of Ser. No. 987,011, Dec. 7, 1992, abandoned.

[30] Foreign Application Priority Data

Dec. 20, 1991 [DE] Germany ..... 4142255

[51] Int. Cl.[5] ..... B61F 5/38

[52] U.S. Cl. ..... 105/166; 105/168

[58] Field of Search ..... 105/166, 167, 168, 196, 105/218.2

[56] References Cited

U.S. PATENT DOCUMENTS

| | | | |
|---|---|---|---|
| 1,408,167 | 2/1922 | Brilhart | 105/166 X |
| 1,417,135 | 5/1922 | Brilhart | 105/166 X |
| 2,792,791 | 5/1957 | Kreissig | 105/168 X |
| 4,542,700 | 9/1985 | Smith | 105/166 |
| 4,679,507 | 7/1987 | Rassaian | 105/168 X |

*Primary Examiner*—Robert J. Oberleitner
*Assistant Examiner*—S. Joseph Morano
*Attorney, Agent, or Firm*—Herbert L. Lerner; Laurence A. Greenberg

[57] ABSTRACT

A running gear for rail vehicles includes a running gear frame having a central axis and pivot points secured to the running gear frame, a middle wheelset, two end wheelsets and pivot points facing the end wheelsets. Oblique guide rods are each pivotably connected between a respective one of the pivot points secured to the running gear frame and a respective one of the pivot points facing the end wheelsets. The pivot points facing the end wheelsets are disposed farther outward or farther away from the central axis than the pivot points secured to the running gear frame, for generating an a radial or virtually radial adjustment of the wheelset by a transverse motion of the wheelset. Levers transmit the transverse motion of the middle wheelset to the oblique guide rods.

1 Claim, 2 Drawing Sheets

RUNNING GEAR FOR RAIL VEHICLES WITH RADIAL CONTROL OF THE WHEELSETS

Figure 1:
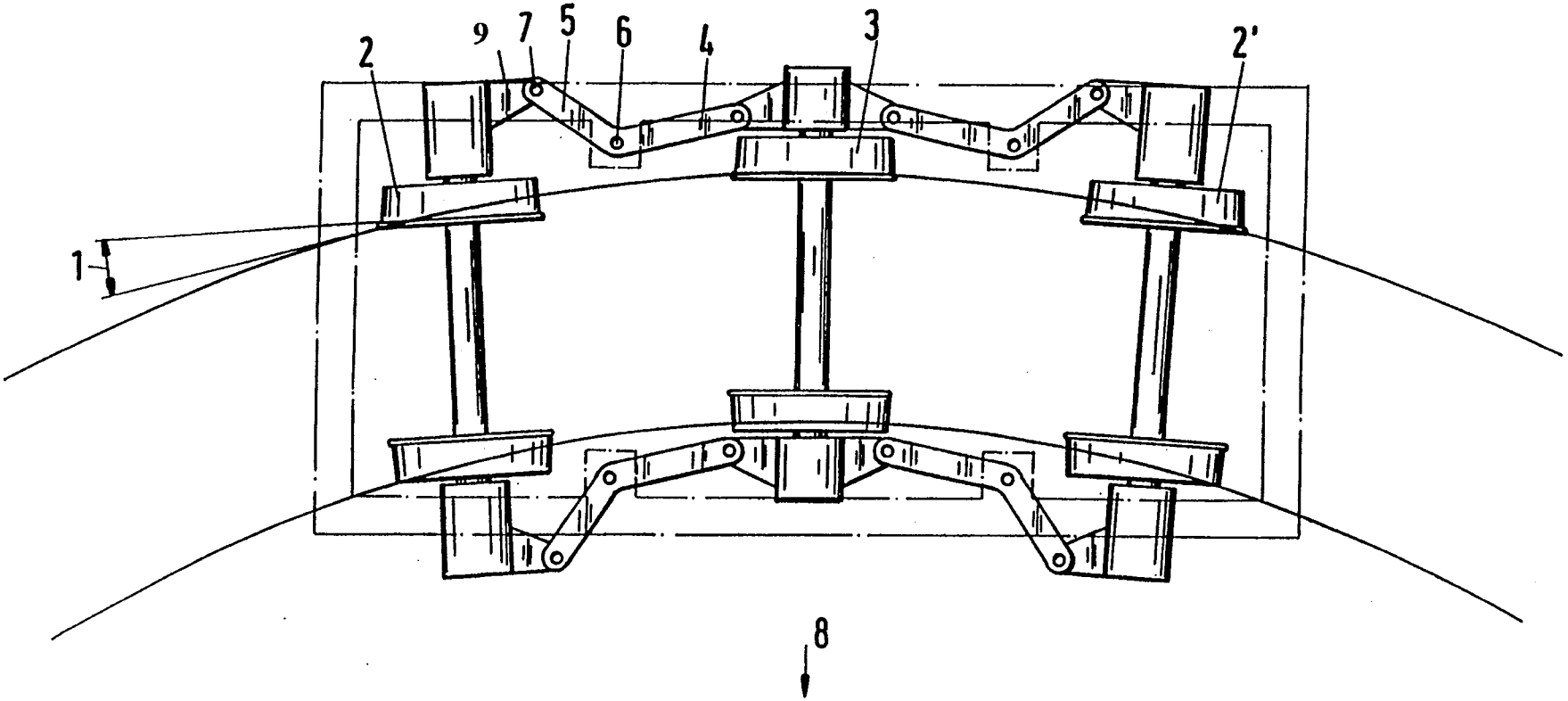

This application is a continuation of application Ser. No. 07/987,011, filed Dec. 7, 1992 now abandoned.

SPECIFICATION

The invention relates to a running gear for rail vehicles having three wheelsets, and a pivotable connection of end wheelsets by oblique guide rods being disposed in such a way that a pivot point oriented toward an end wheelset is located farther outward than a pivot point secured to a running gear frame, so that a radial or virtually radial adjustment of the wheelset is produced by a transverse motion of the wheelset.

In rail vehicles, the wheelsets in running gear frames are usually guided rigidly parallel in the longitudinal direction or with little longitudinal play. When traveling around curves, the parallel position creates increased shear forces and increased wear, especially at the end wheelsets, due to contact with the outer rail at an acute contact angle. Since the wheelset or wheelsets located between the end wheelsets rest on the inner rail in curves because of the position of the running gear, thus forming a kind of chord of the curve, they do not absorb any of the outwardly exerted centrifugal force. Nor does that occur with the known construction having transversely displaceable middle wheelsets. That provision merely relieves the rail of additional forces resulting from the jamming of the running gear in between the inner rail and the outer rail.

In running gear having two or more axles, it is known to direct the end wheelsets into a radial or virtually radial position by means of longitudinal guide rods disposed obliquely to the longitudinal direction of the vehicle, by means of the displacement of the wheelsets transversely to the travel direction resulting from centrifugal force in the curve. The turnout of the obliquely disposed longitudinal guide rod produces a longitudinal displacement of the wheelset bearing, which is in opposite directions on the left and right. In that process, however, the wheelsets located between the end wheelsets are not included in the control. They are transversely displaceably guided independently of the end wheelsets in a known manner. Moreover, such a structure acts in the sense of radially adjusting the wheelsets only whenever notable excess centrifugal force occurs as a result of relatively high travel speeds. At low travel speeds, no notable control effect and therefore no notable advantage over rigidly constructed wheelsets is attained.

Various configurations are also known that couple the transverse motions of the middle wheelsets and the radial adjustment of the end wheelsets with rod linkages. However, those known configurations are typically influenced by longitudinal forces as a result of tractile or braking forces of the vehicle, in such a way that the control effect is affected negatively and the desired effects are undone.

It is accordingly an object of the invention to provide a running gear for rail vehicles, with radial control of the wheelsets, which overcomes the hereinafore-mentioned disadvantages of the heretofore-known devices of this general type, which reduces the contact angle in order to minimize wear and contact forces, and which controls the wheelsets located between the end wheelsets in such a way that they transmit centrifugal force to the outer rail, whereupon the influence of tractile and braking forces on the control of the wheelsets is minimized or precluded.

With the foregoing and other objects in view there is provided, in accordance with the invention, a running gear for rail vehicles, comprising a running gear frame having a central axis and pivot points secured to the running gear frame, a middle wheelset, two end wheelsets and pivot points facing or being oriented toward the end wheelsets, guide rods being disposed obliquely to the longitudinal direction of the vehicle, each of the guide rods being pivotably connected between a respective one of the pivot points secured to the running gear frame and a respective one of the pivot points facing the end wheelsets, the pivot points facing the end wheelsets being disposed farther outward or farther away from the central axis than the pivot points secured to the running gear frame, for generating a radial or virtually radial adjustment of the wheelset by a transverse motion of the wheelset, and levers for transmitting the transverse motion of the middle wheelset to the oblique guide rods.

It can therefore be seen that the wheelsets located between the end wheelsets are pivotably connected by longitudinal guide rods or levers that are connected with the oblique guide rods of the end wheelsets, in such a way that the transverse motion of the wheelsets located between the end wheelsets is coupled in contrary motion with the transverse motion of the end wheelsets.

In accordance with a concomitant feature of the invention, the levers couple the end wheelsets to the oblique guide rods only at two diagonally opposed locations.

Other features which are considered as characteristic for the invention are set forth in the appended claims.

Although the invention is illustrated and described herein as embodied in a running gear for rail vehicles, with radial control of the wheelsets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

Figure 2:
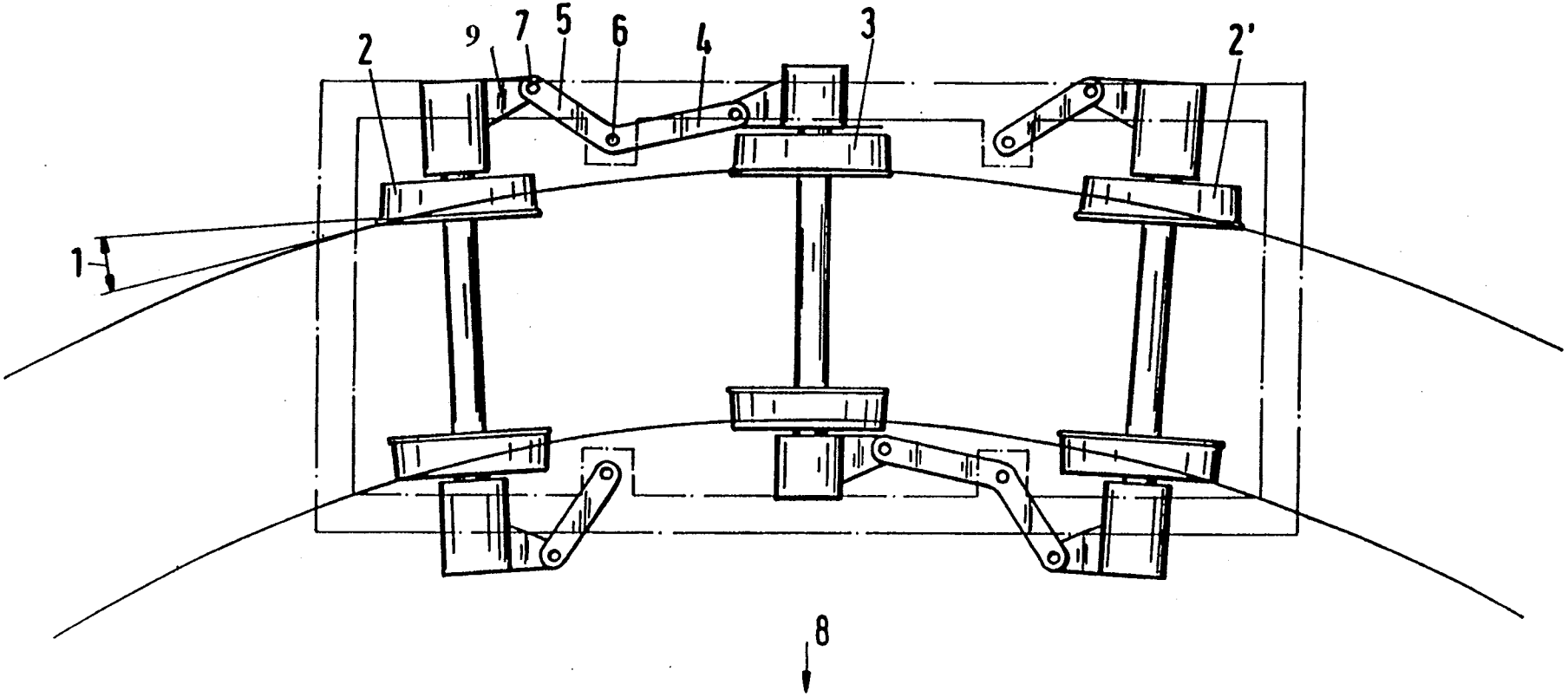

FIG. 1 is a diagrammatic, top-plan view of a running gear for rail vehicles, with three wheelsets in a "curve travel" position; and FIG. 2 is view similar to FIG. 1 of another embodiment of the invention.

Referring now to the figures of the drawing in detail and first, particularly, to FIG. 1 thereof, there is seen an exemplary embodiment of a running gear with two end wheelsets 2, 2' and a middle wheelset 3. If the running gear enters a curve, then the middle wheelset 3 is displaced by the geometry of the curve toward the outside of the curve, relative to the center of the running gear located in the cord position. A knee lever is comprised of a guide rod or lever 4 of the middle wheelset 3 rigidly horizontally joined to a guide rod 5 of the end wheelset 2 pivoted about a pivot point 6 secured to a running gear frame which is shown in phantom lines. Through the use of the guide rod or lever 4, the end wheelset 2 is displaced toward the inside of the curve, counter to the middle wheelset 3, due to the fact that the guide rod 5 is pivoted about the pivot point 6. At the same time, the aforementioned swiveling motion generates a displacement of pivot points 7 at the wheelset in the longitudinal direction. This displacement acts in opposite directions at the right and the left of the running gear and thus adjusts the axle of the end wheelset 2 to a virtually radial position oriented approximately toward a center 8 of the curve. The ends of the knee levers are connected to the axles through knuckles 9.

During travel at relatively high speeds and thus relatively high transverse acceleration, centrifugal force causes the frame of the running gear to experience shear forces oriented toward the outside of the curve. Since the end wheelset is substantially kept in its transverse position by the tracking forces, a motion of the running gear relative to the end wheelsets takes place, which is enabled by the transverse resiliency of the wheelset relative to the running gear frame. The pivot point 6 is displaced transversely, so that a swiveling motion of the guide rod 5 about the pivot point 6 is generated, which virtually radially adjusts the end wheelset 2, as described above. At the same time, the middle wheelset 3 is displaced toward the outside of the curve, through the guide rod or lever 4. This displacement generates a force that is additionally oriented toward the outside of the curve at the middle wheelset 3, and this force reinforces the transverse displacement of the middle wheelset 3, in addition to the above-described transverse displacement out of the geometric position in the curve. The middle wheelset 3 accordingly reaches a position in the direction of the outside of the curve that places it in such a position as to transmit tracking forces in the direction of centrifugal force toward the outside of the curve.

As a result of the structure according to the invention, the end wheelsets 2, 2' are relieved of centrifugal force, and as a result the shear force level of the entire running gear drops in a desirable manner. The contact angle 1 is also desirably reduced.

According to a further feature of the invention shown in FIG. 2, for the sake of simplification of the layout and construction, the guide rods or levers 4 between the middle wheelset 3 and the oblique guide rod 5 of the end wheelset 2 are disposed only on one side. A connection then takes place with the other end wheelset 2' at a diagonally opposite location. As a rule, the very small deviations in the location of the middle wheelset that is perpendicular to the longitudinal axis of the running gear, which result upon vertical spring deflection because of the diagonal configuration, can be considered negligible, because an adaptation by the intrinsic control behavior of the wheelset in the track is permitted by the intentionally present elasticities in the joints of the pivotable connection.

I claim:

1. A three-axle running gear for rail vehicles, comprising:

a rigid running gear frame having mutually opposite side walls and defining a longitudinal axis;

two end wheelsets with axles supported on said rigid running gear frame and a middle wheelset with an axle supported on said frame between said two end wheelsets;

said middle wheelset being substantially unpivotably mounted on said frame and being movable transversely to said longitudinal axis;

said two end wheelsets being pivotably mounted on said frame;

connecting rods connected between said end wheelsets and said middle wheelset for pivotally guiding said end wheelsets; said connecting rods being in the form of knee levers having ends;

said connecting rods being pivotally connected to said frame at pivot points formed at said opposite side walls of said frame, and said ends of said knee levers being pivotally supported in further pivot points;

said further pivot points being formed by steering knuckles disposed at said axles of said middle wheelset and said end wheelsets, respectively.

* * * * *